US005650253A

United States Patent [19]

Baker et al.

[11] Patent Number: 5,650,253

[45] Date of Patent: Jul. 22, 1997

[54] METHOD AND APPARATUS HAVING IMPROVED IMAGE TRANSFER CHARACTERISTICS FOR PRODUCING AN IMAGE ON A RECEPTOR MEDIUM SUCH AS A PLAIN PAPER

[75] Inventors: James A. Baker, Hudson, Wis.; Truman F. Kellie, Lakeland, Minn.; Edward J. Woo, Woodbury, Minn.; Kent E. Emerson, South St. Paul, Minn.; Wu-Shyong Li, Woodbury, Wash.; Gaye K. Lehman, St. Paul, Minn.; Gay L. Herman, Cottage Grove, Minn.; Brian P. Teschendorf, St. Paul, Minn.; Claire A. Jalbert, Cottage Grove, Minn.; Valdis Mikelsons, Mendota Heights, Minn.

[73] Assignee: Minnesota Mining and Manufacturing Company, Saint Paul, Minn.

[21] Appl. No.: 536,687

[22] Filed: Sep. 29, 1995

[51] Int. Cl.[6] ..... G03G 13/11

[52] U.S. Cl. ..... 430/119; 430/126; 399/307

[58] Field of Search ..... 430/117, 119, 430/126; 355/256, 260, 279

[56] References Cited

U.S. PATENT DOCUMENTS

| | | | |
|---|---|---|---|
| 3,376,133 | 4/1968 | Roteman | 96/1.2 |
| 3,411,936 | 11/1968 | Rotsman | 117/37 |
| 3,554,836 | 1/1971 | Steindorf | 156/240 |
| 3,832,170 | 8/1974 | Nagamatsu et al. | 96/1.2 |
| 4,017,891 | 4/1977 | Helmberger et al. | 358/6 |
| 4,033,688 | 7/1977 | Orthmann | 355/4 |
| 4,312,932 | 1/1982 | Hauser et al. | 430/41 |
| 4,403,848 | 9/1983 | Snelling | 355/4 |
| 4,480,022 | 10/1984 | Alexandrovich | 430/119 |
| 4,578,331 | 3/1986 | Ikeda et al. | 430/42 |
| 4,728,983 | 3/1988 | Zwadlo et al. | 355/4 |
| 4,877,698 | 10/1989 | Watson et al. | 430/45 |
| 5,049,949 | 9/1991 | Parker et al. | 355/328 |
| 5,061,583 | 10/1991 | Zwadlo et al. | 430/45 |
| 5,083,163 | 1/1992 | Brown et al. | 355/219 |
| 5,085,967 | 2/1992 | Usui et al. | 430/125 |
| 5,115,277 | 5/1992 | Camis | 355/273 |
| 5,136,334 | 8/1992 | Camis et al. | 355/256 |
| 5,204,722 | 4/1993 | Thompson et al. | 355/279 |
| 5,262,259 | 11/1993 | Chou et al. | 430/47 |
| 5,276,492 | 1/1994 | Landa et al. | 355/277 |
| 5,283,148 | 2/1994 | Rao | 430/114 |
| 5,291,251 | 3/1994 | Storlie et al. | 355/271 |
| 5,300,900 | 4/1994 | Thompson | 355/256 |
| 5,320,923 | 6/1994 | Nguyen | 430/78 |
| 5,397,669 | 3/1995 | Rao | 430/108 |
| 5,420,675 | 5/1995 | Thompson et al. | 430/117 |
| 5,436,706 | 7/1995 | Landa et al. | 430/117 |

FOREIGN PATENT DOCUMENTS

| | | | |
|---|---|---|---|
| 0 287 256 | 10/1988 | European Pat. Off. . | |
| 0 372 764 | 6/1990 | European Pat. Off. . | |
| 0 432 458 | 6/1991 | European Pat. Off. . | |
| 0 437 073 | 7/1991 | European Pat. Off. . | |
| 0 513 820 A2 | 11/1992 | European Pat. Off. | G03G 15/01 |
| 0 549 867 A2 | 7/1993 | European Pat. Off. | G03G 15/16 |
| 0 672 965 A1 | 9/1995 | European Pat. Off. | G03G 15/11 |
| 6-138712 | 5/1994 | Japan | G03G 9/12 |
| 6-138718 | 5/1994 | Japan | G03G 9/13 |
| 6-149001 | 5/1994 | Japan | G03G 15/01 |
| 60214431 | 5/1994 | Japan | G03G 9/13 |
| 7312934 | 3/1975 | Netherlands . | |

OTHER PUBLICATIONS

Osmond, D.W.J., et al., "The Theoretical Basis for the Steric Stabilization of Polymer Dispersions Prepared in Organic Media", *Dispersion Polymerization in Organic Media*, pp. 9–43.

Wicks, Jr., Zeno W., "Film Formation", *Federation of Societies for Coatings Technology*, Jun. 1986, pp. 7–19.

*Primary Examiner*—John Goodrow

*Attorney, Agent, or Firm*—Carolyn A. Bates; William D. Bauer

[57] ABSTRACT

Method and apparatus for producing an image on plain paper from image data using a photoreceptor. An image-wise distribution of charges is produced on the photoreceptor corresponding to the image data. A liquid ink having solid charged pigmented particles, the liquid ink having an effective glass transition temperature of less than 25 degrees Celsius is applied to the photoreceptor forming an image-wise distribution of the pigmented particles on the photoreceptor to form the image. The liquid ink has greater than seventy-five percent by volume fraction of solids in the image. A film forming means is positioned against the photoreceptor immediately following the application means to dry the image of the liquid ink to film forming within 0.5 seconds. The image is dried on the photoreceptor. The image is then transferred to an elastomeric transfer roller which forms a first transfer nip under pressure with the photoreceptor. The elastomeric transfer roller is heated to from 50 degrees Celsius to 100 degrees Celsius. Subsequently, the image is transferred to plain paper through a nip formed between a backup roller under pressure with the transfer roller. The release layer of the photoreceptor has a surface energy which is less than a surface energy of the elastomeric transfer roller which in turn is less than a surface energy of the liquid ink which in turn is less than a surface energy of the plain paper.

4 Claims, 3 Drawing Sheets

METHOD AND APPARATUS HAVING IMPROVED IMAGE TRANSFER CHARACTERISTICS FOR PRODUCING AN IMAGE ON A RECEPTOR MEDIUM SUCH AS A PLAIN PAPER

TECHNICAL FIELD

The present invention relates generally to apparatus and methods for producing an image on a receptor medium such as plain paper and, more specifically, to apparatus and methods such as electrographic apparatus having dry image transfer characteristics.

BACKGROUND OF THE INVENTION

In conventional electrophotography systems, a photoreceptor is supported by a mechanical carrier such as a drum or a belt. First, the photoreceptor is erased by exposure to an erase lamp which "bleeds" away any residual charge remaining on the photoreceptor from previous operations. The photoreceptor then is charged to a generally uniform charge, positive or negative, by subjecting the photoreceptor to a suitable charging device such as a corona or a charge roll. The charge distribution on the photoreceptor is then altered by the image-wise application of radiation, e.g., a laser, to the surface of the photoreceptor creating a latent image corresponding to the image-wise application of radiation on the photoreceptor. Toner is attracted to the photoreceptor in a pattern consistent with the charge distribution of the photoreceptor. The toner is then typically transferred, either directly or through an intermediate medium, from the photoreceptor to a receptor material or medium being printed, e.g., paper or film.

Such an electrophotography process enables the production of high quality images on the receptor material, such as film or paper. Apparatus which may utilize electrophotography include conventional laser printers, photocopiers, proofers, etc.

Monochrome printers produce a hard copy output in one toner color only, typically black. If the laser printer is to be used to print a different color, the conventional black toner cartridge is removed and replaced with a toner cartridge containing toner of another color, e.g., red. However, the laser printer still prints only a single color.

On the other hand, color printers use three primary colors, typically cyan, magenta and yellow, and in addition, optionally, black. Several techniques have been developed over the years to adapt electrophotographic techniques to use multiple colors.

U.S. Pat. No. 4,728,983, Zwadlo et al, Single Beam Full Color Electrophotography, assigned to Minnesota Mining and Manufacturing Company, the assignee of the present invention, discloses a method of making high quality color prints by electrophotography. A single photoconductive drum is used together with means to erase, electrostatically charge, laser-scan expose and toner develop during a single rotation of the photoconductive drum. In successive rotations, different colored images corresponding to color separation images are assembled in register on the drum. This assembled color image is transferred to a receptor sheet in a final rotation of the drum. Because a separate pass, i.e., rotation, is required for each primary color plane, at least four passes (rotations) are needed to obtain the final four color image print. Separate passes for each of the primary color planes significantly restricts the speed which a multiple color electrophotographic printing process can achieve.

Zwadlo et al and other similar apparatus have difficulty printing a multicolored image and then transferring such image directly or indirectly to plain paper or a transparency. It is necessary, following the teaching of Zwadlo et al, to print the desired image on an intermediate transfer material, such as a release liner or transfer adhesive, instead of plain paper or transparency film. Thus, these apparatus are not suitable for use in the general office printing market which must print on commonly available "plain" paper used in commercial offices.

In the Zwadlo et al system, the obstacle to printing on plain paper with an electrographic system is severe. For a standard four color image, four individual color planes of the final image must be laid down in registration on a photoreceptor. Each color plane must adhere first to the photoreceptor itself and, then, to the preceding color plane. Further each color plane, except the last, must survive intact without significant image degradation as subsequent color planes are laid on top. After all four color planes are assembled, all four color planes must be transferred intact to plain paper which may be medium commonly used in an office environment such as copier paper of various grades, weights and smoothness to transparency film.

Another difficulty in printing directly to plain paper arises from the thinness of the toner layers contained in the final image to be printed. Each toner layer may be less than 4 micrometers which makes the layer very fragile and difficult to manipulate. The thickness of a four color stack, approximately 4 micrometers, relative to the RMS roughness of paper, approximately 6 micrometers, makes it very difficult to effect complete image transfer to plain paper.

Other typical processes which print on plain paper rely on electrostatic assist to effect image transfer from an organic photoconductor. Examples of these processes are described in U.S. Pat. No. 4,728,983, Zwadlo et al; and U.S. Pat. No. 5,061,583, Zwadlo et al; U.S. Pat. No. 5,085,967, Usui et al; U.S. Pat. No. 5,115,277, Camis; U.S. Pat. No. 5,276,492; and U.S. Pat. No. 5,300,990, Thompson.

SUMMARY OF THE INVENTION

The present invention eliminates the necessity of relying on electrostatic assist and overcomes the other drawbacks by providing an electrographic system and method in which a dry adhesive transfer technique is used to achieve full image transfer. The dry adhesive transfer technique operates without requiring differential charge levels to transfer the image from the photoreceptor to plain paper or to any intermediate transfer medium. The dry adhesive transfer technique relies on the characteristics of liquid toners used in the electrographic process, the relative surface energies between the surface of the photoreceptor, the liquid toners, an intermediate transfer media and the "plain" paper as well as certain temperatures and pressures. Preferably, the dry adhesive transfer technique relies on fixing each color plane immediately following development of that color plane on the photoreceptor and, still more preferably, on drying the resultant four color plane image before transfer of that image to an intermediate transfer media.

In one embodiment, the present invention is an apparatus for producing an image on a receptor media from image data. A photoreceptor has a surface release. A charge producing mechanism produces an image-wise distribution of charges on the photoreceptor corresponding to the image data. Liquid ink has solid charged pigmented particles and an effective glass transition temperature of not less than minus 10 degrees Celsius but at least one degree less than the temperature at which development takes place. An application mechanism applies the liquid ink to the photoreceptor forming an image-wise distribution of the pigmented particles on the photoreceptor to form the image. A film forming mechanism is positioned against the photoreceptor immediately following the application mechanism and dries the image of the liquid ink to film forming within 0.5 seconds so that the liquid ink has greater than seventy-five percent by volume fraction of solids in the image. A drying mechanism is positioned proximate the photoreceptor following the film forming means and dries the image on the photoreceptor. An elastomeric transfer roller forms a first transfer nip under pressure with the photoreceptor, receives the image from the photoreceptor. The elastomeric transfer roller is heated to from 50 degrees Celsius to 100 degrees Celsius. A backup roller forms a second transfer nip under pressure with the transfer roller with the receptor media passing through the second transfer nip and receiving the image from the transfer roller. The release layer of the photoreceptor has a surface energy which is less than a surface energy of the elastomeric transfer roller. The surface energy of the elastomeric transfer roller is less than a surface energy of the liquid ink. The surface energy of the image formed by liquid ink is less than a surface energy of the receptor media.

In another embodiment, the present invention is an apparatus for producing a multi-colored image on a receptor media from image data representing a plurality of color planes. A photoreceptor has a surface release layer. A charge producing mechanism produces an image-wise distribution of charges on the photoreceptor corresponding to the image representing one of the plurality of color planes. A first liquid ink has solid charged pigmented particles and an effective glass transition temperature of not less than minus 10 degrees Celsius but at least one degree less than the temperature at which development takes place, the pigmented particles being substantially representative of one of the plurality of color planes. A first application mechanism applies the first liquid ink to the photoreceptor forming an image-wise distribution of the pigmented particles on the photoreceptor to form one of the plurality of color planes. A first film forming mechanism is positioned against the photoreceptor immediately following the first application mechanism and dries the image of the liquid ink to film forming within 0.5 seconds so that the first liquid ink has greater than seventy-five percent by volume fraction of solids in the image. A second liquid ink has solid charged pigmented particles has an effective glass transition temperature of not less than minus 10 degrees Celsius but at least one degree less than the temperature at which development takes place, the pigmented particles being substantially representative another of the plurality of color planes. A second application mechanism applies the second liquid ink to the photoreceptor forming an image-wise distribution of the pigmented particles on the photoreceptor to form another of the plurality of color planes. A second film forming means is positioned against the photoreceptor immediately following the second application mechanism to dry the image of the liquid ink to film forming within 0.5 seconds. A drying mechanism is positioned proximate the photoreceptor following the film forming means for drying the image on the photoreceptor so that the first liquid ink and the second liquid ink have greater than seventy-five percent by volume fraction of solids in the image. An elastomeric transfer roller forms a first transfer nip under pressure with the photoreceptor and receives the plurality of color planes from the photoreceptor with the elastomeric transfer roller being heated to from 50 degrees Celsius to 100 degrees Celsius. A backup roller forms a second transfer nip under pressure with the transfer roller and receives the receptor media passing and the plurality of color planes from the transfer roller. The release layer of the photoreceptor has a surface energy which is less than a surface energy of the elastomeric transfer roller. The surface energy of the elastomeric transfer roller is less than a surface energy of the first liquid ink and the second liquid ink. The surface energy of the image formed by the first liquid ink and the second liquid ink is less than the surface energy of the receptor media.

In another embodiment, the present invention is a method of producing an image on a receptor media from image data. An image-wise distribution of charges is produced on a photoreceptor corresponding to the image data. A liquid ink having solid charged pigmented particles and an effective glass transition temperature of not less than minus 10 degrees Celsius but at least one degree less than the temperature at which development takes place is applied forming an image-wise distribution of the pigmented particles on the photoreceptor to form the image, the liquid ink having an effective glass transition temperature of not less than 10 degrees Celsius but at least one degree less than the temperature at which development takes place. The image is fixed immediately following the applying step with a film forming means positioned against the photoreceptor to dry the image of the liquid ink to film forming within 0.5 seconds so that the image has greater than seventy-five percent by volume fraction of solids. The image is then dried on the photoreceptor following the film forming means. The image is transferred from the photoreceptor to an elastomeric transfer roller forming a first transfer nip under pressure with the photoreceptor, the elastomeric transfer roller being heated to from 50 degrees Celsius to 100 degrees Celsius. The image is again transferred from the elastomeric transfer roller to a receptor medium in a second transfer nip under pressure from a backup roller, the receptor media passing through the second transfer nip. The release layer of the photoreceptor has a surface energy which is less than a surface energy of the elastomeric transfer roller. The surface energy of the elastomeric transfer roller is less than a surface energy of the liquid ink. The surface energy of the image formed by the liquid ink is less than a surface energy of the receptor media.

In another embodiment, the present invention is a method of producing a multi-colored image on a receptor media from image data representing a plurality of color planes. An image-wise distribution of charges corresponding to the image is produced representing one of the plurality of color planes on a photoreceptor having a surface release layer. The first liquid ink is a first liquid ink having solid charged pigmented particles to the photoreceptor forming an image-wise distribution of the pigmented particles on the photoreceptor to form one of the plurality of color planes, the first liquid ink having an effective glass transition temperature of not less than minus 10 degrees Celsius but at least one degree less than the temperature at which development takes place, the pigmented particles being substantially representative the one of the plurality of color planes. The one of the plurality of color planes immediately following the first applying step dries the image of the liquid ink to film forming within 0.5 seconds with a first film forming means positioned against the photoreceptor so that the one of the plurality of color planes has greater than seventy-five percent by volume fraction of solids. Applying a second liquid ink having solid charged pigmented particles to the photoreceptor forming an image-wise distribution of the pigmented particles on the photoreceptor to form another of the plurality of color planes. The second liquid ink has an effective glass transition temperature of not less than minus 10 degrees Celsius but at least one degree less than the temperature at which development takes place, the pigmented particles being substantially representative of another of the plurality of color planes. Another of the plurality of color planes is fixing immediately following the second applying step to dry the image of the liquid ink to film forming within 0.5 seconds with a second film forming means positioned against the photoreceptor so that the another of the plurality of color planes has greater than seventy-five percent by volume fraction of solids. The image is dried by a second film forming means. The image is dried on said photoreceptor following the second film forming means. The image from the photoreceptor is transferred to an elastomeric transfer roller forming a first transfer nip under pressure with the photoreceptor, the elastomeric transfer roller being heated to from 50 degrees Celsius to 100 degrees Celsius. The image is again transferred from the elastomeric transfer roller to a receptor medium in a second transfer nip under pressure from a backup roller, the receptor media passing through the second transfer nip. The release layer of the photoreceptor has a surface energy which is less than a surface energy of the elastomeric transfer roller. The surface energy of the elastomeric transfer roller is less than a surface energy of the liquid ink. The surface energy of image formed by the liquid ink is less than a surface energy of the receptor media.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENT

Liquid electrophotography is a technology which produces or reproduces an image on paper or other desired receptor material. Liquid electrophotography uses liquid inks which may be black or which may be of different colors for the purpose of plating solid material onto a surface in a well controlled and image-wise manner to create the desired prints. In some cases, liquid inks used in electrophotography are substantially transparent or translucent to radiation emitted at the wavelength of the latent image generation device so that multiple image planes can be laid over one another to produce a multi-colored image constructed of a plurality of image planes with each image plane being constructed with a liquid ink of a particular color. Typically, a colored image is constructed of four image planes. The first three planes are constructed with a liquid ink in each of the three subtractive primary printing colors, yellow, cyan and magenta. The fourth image plane uses black ink which need not be transparent to radiation emitted at the wavelength of the latent image generation device.

Figure 1:
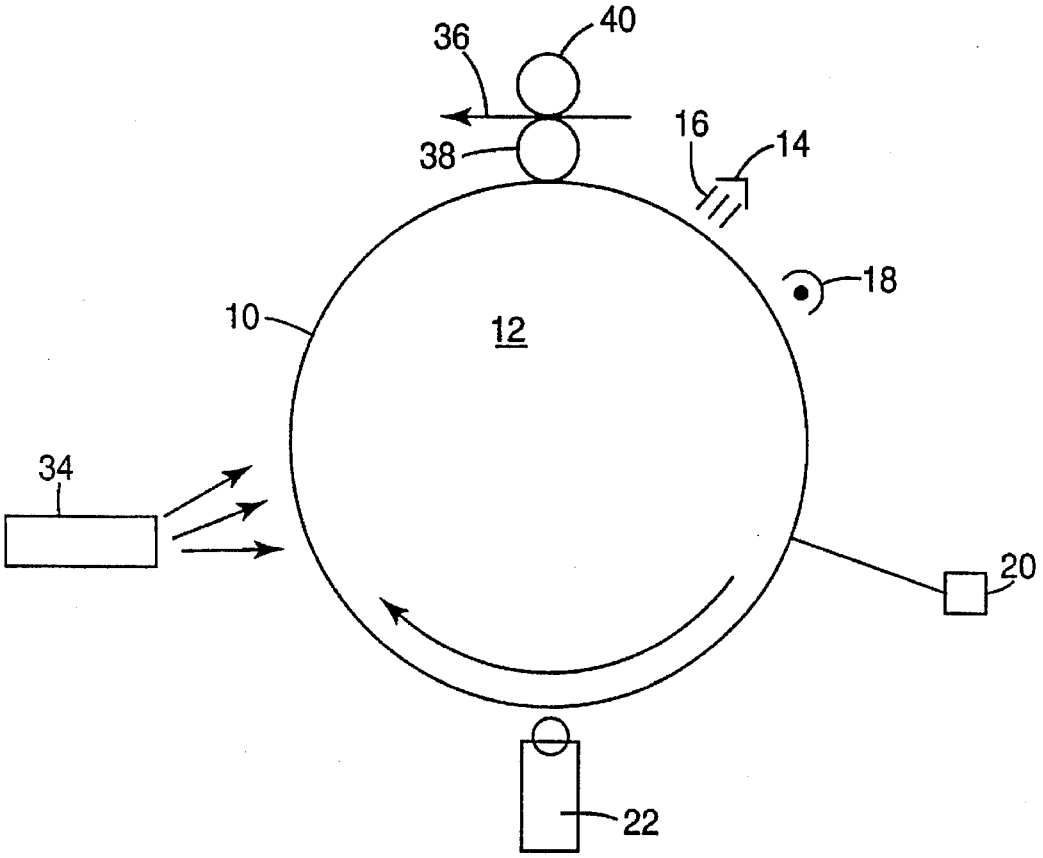
FIGS. 1 and 2 are a diagrammatic illustration of a basic liquid electrophotographic process in which the present invention has utility and apparatus for performing that process.

The process involved in liquid electrophotography can be illustrated with respect to a single color by reference to FIG. 1. Light sensitive, organic photoreceptor 10 is arranged on or near the surface of a mechanical carrier such as drum 12. The mechanical carrier could, of course, be a belt or other movable support object. Drum 12 rotates in the clockwise direction of FIG. 1 moving a given location of photoreceptor 10 past various stationary components which perform an operation relative to photoreceptor 10 or an image formed on drum 12.

Of course, other mechanical arrangements could be used which provide relative movement between a given location on the surface of photoreceptor 10 and various components which operate on or in relation to photoreceptor 10. For example, organic photoreceptor 10 could be stationary while the various components move past photoreceptor 10 or some combination of movement between both photoreceptor 10 and the various components could be facilitated. It is only important that there be relative movement between organic photoreceptor 10 and the other components. As this description refers to organic photoreceptor 10 being in a certain position or passing a certain position, it is to be recognized and understood that what is being referred to is a particular spot or location on organic photoreceptor 10 which has a certain position or passes a certain position relative to the components operating on photoreceptor 10.

In FIG. 1, as drum 12 rotates, organic photoreceptor 10 moves past erase lamp 14. When organic photoreceptor 10 passes under erase lamp 14, radiation 16 from erase lamp 14 impinges on the surface of photoreceptor 10 causing any residual charge remaining on the surface of photoreceptor 10 to "bleed" away. Thus, the surface charge distribution of the surface of photoreceptor 10 as it exits erase lamp 14 is quite uniform and nearly zero depending upon the photoreceptor.

As drum 12 continues to rotate and organic photoreceptor 10 next passes under charging device 18, such as a roll corona, a uniform positive or negative charge is imposed upon the surface of photoreceptor 10. In a preferred embodiment, the charging device 18 is a positive DC corona. Typically, the surface of photoreceptor 10 is uniformly charged to around 600 volts depending on the capacitance of photoreceptor. This prepares the surface of photoreceptor 10 for an image-wise exposure to radiation by laser scanning device 20 as drum 12 continues to rotate. Wherever radiation from laser scanning device 20 impinges on the surface of photoreceptor 10, the surface charge of photoreceptor 10 is reduced significantly while areas on the surface of photoreceptor 10 which do not receive radiation are not appreciably discharged. Areas of the surface of photoreceptor 10 which receive some radiation are discharged to a degree that corresponds to the amount of radiation received. This results in the surface of photoreceptor 10 having a surface charge distribution which is proportional to the desired image information imparted by laser scanning device 20 when the surface of photoreceptor 10 exits from under laser scanning device 20.

As drum 12 continues to rotate, the surface of photoreceptor 10 passes by liquid ink developer station 22. The operation of liquid ink developer station 22 can be more readily understood by reference to FIG. 2. Liquid ink 24 is applied to the surface of image-wise charged organic photoreceptor 10 in the presence of an electric field which is established by placing electrode 26, illustrated as a roller, near the surface of photoreceptor 10 and imposing a bias voltage on electrode 26. Liquid ink 24 consists of positively charged "solid", but not necessarily opaque, toner particles of the desired color for this portion of the image being printed. The "solid" material in the ink, under force from the established electric field, migrates to and plates upon the surface of photoreceptor 10 in areas 28 where the surface voltage is less than the bias voltage of electrode 26. The "solid" material in the ink will migrate to and plate upon the electrode in areas 30 where surface voltage of photoreceptor 10 is greater than the bias voltage of electrode 26. Excess liquid ink not sufficiently plated to either the surface of photoreceptor 10 or to electrode 26 is removed. A preferred means of removing this excess liquid ink is using the "crowned squeegee roller" described in copending U.S. Pat. Application filed on even date herewith in the names of Moe et al, entitled Squeegee Apparatus and Method for Removing Developer Liquid From an Imaging Substrate and Fabrication Method, identified by File No. 52066USA6A, the contents of which is hereby incorporated by reference.

The ink is further dried by drying mechanism 32 which may include a roll, vacuum box or curing station. Drying mechanism 32 substantially transforms liquid ink 24 into a substantially dry ink film. The excess liquid ink 24 then returns to liquid ink developer station 22 for use in a subsequent operation. The "solid" portion 28 (ink film) of liquid ink 24 plated upon the surface of photoreceptor 10 matches the previous image-wise charge distribution previously place upon the surface of photoreceptor 10 by laser scanning device 20 and, hence, is an image-wise representation of the desired image to be printed.

Referring again to FIG. 1, ink film 28 from liquid ink 24 is further dried by drying mechanism 34. Drying mechanism 34 may be passive, may utilize active air blowers or may be other active devices such as rollers. In a preferred embodiment, drying mechanism 34 is a drying roll or image conditioning roller. Such an apparatus is described in U.S. Pat. No. 5,420,675, which is hereby incorporated by reference.

The ink film 28 portion of liquid ink 24, representing the desired image to be printed, is then transferred, either directly to the medium 36 to be printed, or preferably and as illustrated in FIG. 1, indirectly by way of transfer rollers 38 and 40. Transfer is effected by differential tack of ink film 28 and transfer rollers 38 and 40. Typically, heat and pressure are utilized to fuse the image to medium 36. The resultant "print" is a hard copy manifestation of the image information written by laser scanning device 22 and is of a single color, the color represented by liquid ink 24.

Figure 2:
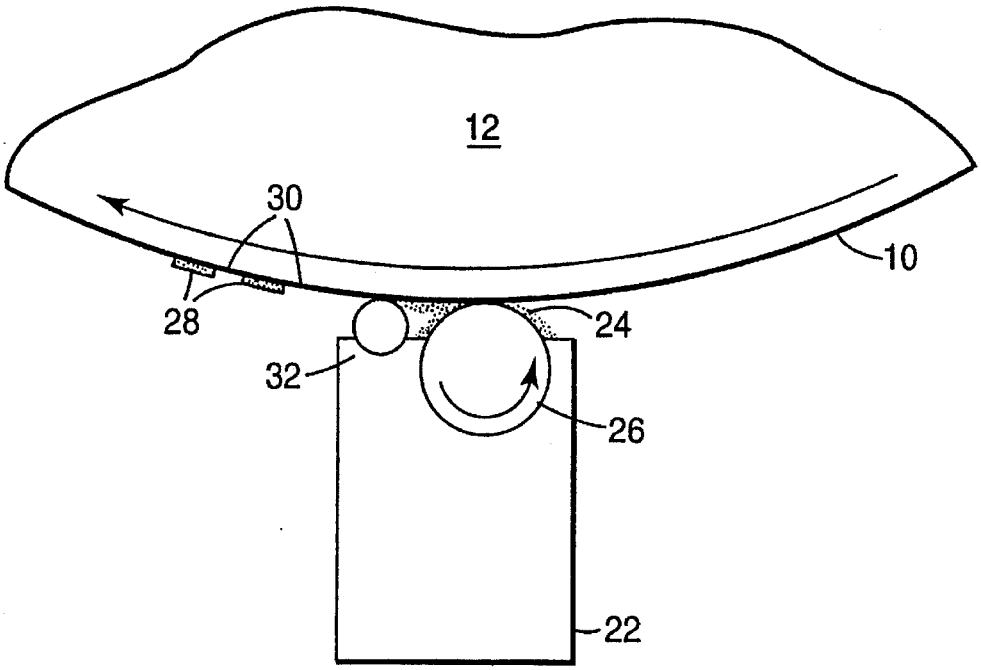

While organic photoreceptor 10, drum 12, erase lamp 14, charging device 18, laser scanning device 20, liquid ink developer station 22, liquid ink 24, electrode 26, squeegee 32, drying mechanism 34 and transfer rollers 38 and 40 have been only diagrammatically illustrated in FIGS. 1 and 2 and only generally described with relation thereto, it is to be recognized and understood that these components are generally well known in the art of electrophotography and the exact material and construction of these elements is a matter of design choice which is also well understood in the art.

It is possible, of course, to make prints containing many colors rather than one single color. The basic liquid electrophotography process and apparatus described in FIGS. 1 and 2 can be used by repeating the process described above for one color, a number of times wherein each repetition may image-wise expose a separate primary color plane, e.g., cyan, magenta, yellow or black, and each liquid ink 24 may be of a separate primary printing color corresponding to the image-wise exposed color plane. Superposition of four such color planes may be achieved with good registration onto the surface of photoreceptor 10 without transferring any of the color planes until all have been formed. Subsequent simultaneous transfer of all of these four color planes to a suitable medium 36 may yield a quality color print. Such as process and apparatus is described in U.S. Pat. No. 4,728,983, Zwadlo et al, Single Beam Full Color Electrophotography, assigned to the assignee of this application, which patent is hereby incorporated by reference.

While the above described liquid electrophotography process is suitable for construction of a multi-colored image, the process is somewhat slow because photoreceptor 10 must repeat the entire sequence for each color of the typical four color colored image. When the above process is performed for a particular color, e.g., cyan, laser scanning device 20 causes areas 20 photoreceptor 10 receiving radiation to at least partially discharged to create a surface charge distribution pattern of the surface of photoreceptor 10 which represents the portion of the image to be reproduced representing that particular color, e.g., cyan. After development by liquid developer station 22, the surface charge distribution of photoreceptor 10 is still quite variable (assuming at least some pattern to the image to be reproduced) and too low to be subsequently imaged. Photoreceptor 10 then must be erased to make the surface charge distribution uniform and must be again charged to provide a sufficient surface charge to allow a subsequent development process to plate liquid ink upon areas 28 of photoreceptor 10.

Figure 3:
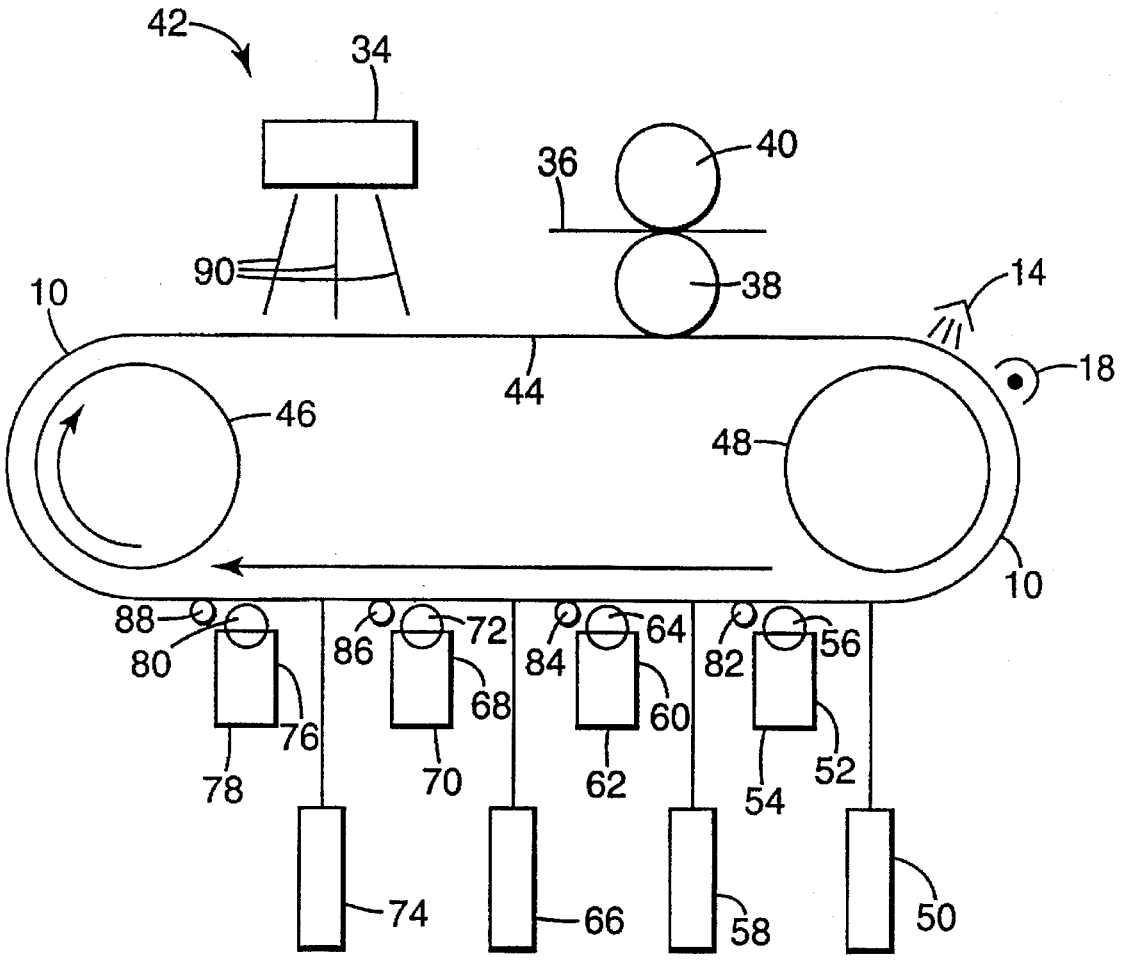
FIG. 3 is a diagrammatic illustration of an apparatus and method for producing a multi-colored image in accordance with the present invention.

While not required by all embodiments of the present invention, FIG. 3 diagrammatically illustrates an apparatus 42 and method for producing a multicolored image. Photoreceptor 10 is mechanically supported by belt 44 which rotates in a clockwise direction around rollers 46 and 48. Photoreceptor 10 is first conventionally erased with erase lamp 14. Any residual charge left on photoreceptor 10 after the preceding cycle is preferably removed by erase lamp 14 and then conventionally charged using charging device 18, such procedures being well known in the art. When so charged, the surface of photoreceptor 10 is uniformly charged to around 600 volts, preferably. Laser scanning device 50, similar to laser scanning device 20 illustrated in FIG. 1, exposes the surface of photoreceptor 10 to radiation in an image-wise pattern corresponding to a first color plane of the image to be reproduced.

With the surface of photoreceptor so image-wise charged, charged pigment particles in liquid ink 54 corresponding to the first color plane will migrate to and plate upon the surface of photoreceptor 10 in areas where the surface voltage of photoreceptor 10 is less than the bias of electrode 56 associated with liquid ink developer station 52. The charge neutrality of liquid ink 54 is maintained by negatively charged counter ions which balance the positively charged pigment particles. Counter ions are deposited on the surface of photoreceptor 10 in areas where the surface voltage is greater than the bias voltage of electrode 56 associated with liquid ink developer station 52.

At this stage, photoreceptor 10 contains on its surface an image-wise distribution of plated "solids" of liquid ink 52 in accordance with a first color plane. The surface charge distribution of photoreceptor 10 has also been recharged with plated ink particles as well as with transparent counter ions from liquid ink 52 both being governed by the image-wise discharge of photoreceptor 10 due to laser scanning device 58. Thus, at this stage the surface charge of photoreceptor 10 is also quite uniform. Although not all of the original surface charge of photoreceptor may have been obtained, a substantial portion of the previous surface charge of photoreceptor has been recaptured. With such solution recharging, photoreceptor 10 is now ready to be processed for the next color plane of the image to be reproduced.

As belt 44 continues to rotate, organic photoreceptor 10 next is image-wise exposed to radiation from laser scanning device 58 corresponding to a second color plane. Note that this process occurs during a single revolution of organic photoreceptor 10 by belt 44 and without the necessity of photoreceptor 10 being subjected to erase subsequent to exposure to laser scanning device 50 and liquid ink development station 52 corresponding to a first color plane. The remaining charge on the surface of photoreceptor 10 is subjected to radiation corresponding to a second color plane. This produces an image-wise distribution of surface charge on photoreceptor 10 corresponding to the second color plane of the image.

The second color plane of the image is then developed by developer station 60 containing liquid ink 60. Although liquid ink 62 contains "solid" color pigments consistent with the second color plane, liquid ink 62 also contains substantially transparent counter ions which, although they may have differing chemical compositions than substantially transparent counter ions of liquid ink 54, still are substantially transparent and oppositely charged to the "solid" color pigments. Electrode 64 provides a bias voltage to allow "solid" color pigments of liquid ink 62 create a pattern of "solid" color pigments on the surface of photoreceptor 10 corresponding to the second color plane. The transparent counter ions also substantially recharge photoreceptor 10 and make the surface charge distribution of photoreceptor 10 substantially uniform so that another color plane may be placed upon photoreceptor 10 without the necessity of erase nor corona charging.

A third color plane of the image to be reproduced is deposited on the surface of photoreceptor 10 is similar fashion using laser scanning device 64 and developer station 66 containing liquid ink 68 using electrode 70. Again, the surface charge existing on photoreceptor 10 following development of the third color plane may be somewhat less than existed prior to exposure to laser scanning device 64 but will be substantially "recharged" and will be quite uniform allowing application of the fourth color plane without the necessity of erase or corona charging.

Similarly, a fourth color plane is deposited upon photoreceptor 10 using laser scanning device 74 and developer station 76 containing liquid ink 78 using electrode 80.

Preferably, excess liquid from liquid inks 54, 62, 70 and 78 is "squeezed" off using a roller similar to roller 32 described with respect to FIG. 1. Such a roller may be used in conjunction with any of developer stations 52, 60, 68 or 76 or all of them.

The plated solids from liquid inks 54, 62, 70 and 78 are dried in a drying mechanism 34 similar to that described with respect to FIG. 1. Drying mechanism 34 may be passive, may utilize active air blowers or may be other active devices such as drying rollers, vacuum devices, coronas, etc.

The completed four color image is then transferred, either directly to the medium 36 to be printed, or preferably and as illustrated in FIG. 3, indirectly by way of transfer rollers 38 and 40. Typically, heat and/or pressure are utilized to fix the image to medium 36. The resultant "print" is a hard copy manifestation of the four color image.

With proper selection of charging voltages, photoreceptor capacity and liquid ink, this process may be repeated an indeterminate number of times to produce a multi-colored image having an indeterminate number of color planes. Although the process and apparatus has been described above for conventional four color images, the process and apparatus are suitable for multi-color images having two or more color planes.

The dry adhesive transfer technique described in the present invention preferably finds utility in a electrophotographic system using solution charging. Such solution charging is described in detail in copending U.S. Pat. Application filed on even date herewith, in the names of Kellie et al, entitled Method And Apparatus For Producing A Multi-Colored Image In An Electrophotographic System, identified by File No. 51325USA5A, the contents of which is hereby incorporated by reference.

One type of ink found particularly suitable for use as liquid inks 52, 60, 68 and 76 consists of ink materials that are substantially transparent and of low absorptivity to radiation from laser scanning devices 50, 58, 66 and 74. This allows radiation from laser scanning devices 50, 58, 66 and 74 to pass through the previously deposited ink or inks and impinge on the surface of photoreceptor 10 and reduce the deposited charge. This type of ink permits subsequent imaging to be effected through previously developed ink images as when forming a second, third, or fourth color plane without consideration for the order of color deposition. It is preferable that the inks transmit at least 80% and more preferably 90% of radiation from laser scanning devices 50, 58, 66 and 74 and that the radiation is not significantly scattered by the deposited ink material of liquid inks 52, 60, 68 and 76.

One type of ink found particularly suitable for use as liquid inks 52, 60, 68 and 76 are gel organosols which exhibit excellent imaging characteristics in liquid immersion development. For example, the gel organosol liquid inks exhibit low bulk conductivity, low free phase conductivity, low charge/mass and adequate mobility, all desirable characteristics for producing high resolution, background free images with high optical density. In particular, the low bulk conductivity, low free phase conductivity and low charge/mass of the inks allow them to achieve high developed optical density over a wide range of solids concentrations, thus improving their extended printing performance relative to conventional inks.

These color liquid inks on development form colored films which transmit incident radiation such as, for example, near infrared radiation, consequently allowing the photoconductor layer to discharge, while non-coalescent particles scatter a portion of the incident light. Non-coalesced ink particles therefore result in the decreasing of the sensitivity of the photoconductor to subsequent exposures and consequently there is interference with the overprinted image.

These inks have low $T_g$ values which enables the inks to form films at room temperature. Normal room temperature (19°–20° C.) is sufficient to enable film forming and of course the ambient internal temperatures of the apparatus during operation which tends to be at a higher temperature (e.g., 25°–40° C.) even without specific heating elements is sufficient to cause the ink or allow the ink to form a film.

Residual image tack after transfer may be adversely affected by the presence of high tack monomers, such as ethyl acrylate, in the organosol. Therefore, the organosols are generally formulated such that the organosol core preferably has a glass transition temperature ($T_g$) less than room temperature (25° C.) but greater than −10° C. A preferred organosol core composition contains about 75 weight percent ethyl acrylate and 25 weight percent methyl methacrylate, yielding a calculated core $T_g$ of =−1° C. This permits the inks to rapidly self-fix under normal room temperature or higher development conditions and also produce tack-free fixed images which resist blocking.

The carrier liquid may be selected from a wide variety of materials which are well known in the art. The carrier liquid is typically oleophilic, chemically stable under a variety of conditions, and electrically insulating. Electrically insulating means that the carrier liquid has a low dielectric constant and a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar G liquid, Isopar H liquid, Isopar K liquid and Isopar L liquid (manufactured by Exxon Chemical Corporation, Houston, Tex.). The preferred carrier liquid is Norpar 12 liquid, also available from Exxon Corporation.

The toner particles are comprised of colorant embedded in a thermoplastic resin. The colorant may be a dye or more preferably a pigment. The resin may be comprised of one or more polymers or copolymers which are characterized as being generally insoluble or only slightly soluble in the carrier liquid; these polymers or copolymers comprise a resin core. In addition, superior stability of the dispersed toner particles with respect to aggregation is obtained when at least one of the polymers or copolymers (denoted as the stabilizer) is an amphipathic substance containing at least one chain-like component of molecular weight at least 500 which is solvated by the carrier liquid. Under such conditions, the stabilizer extends from the resin core into the carrier liquid, acting as a steric stabilizer as discussed in *Dispersion Polymerization* (Ed. Barrett, Interscience., p. 9 (1975). Preferably, the stabilizer is chemically incorporated into the resin core, i.e., covalently bonded or grafted to the core, but may alternatively be physically or chemically adsorbed to the core such that it remains as an integral part of the resin core.

The composition of the resin is preferentially manipulated such that the organosol exhibits an effective glass transition temperature (Tg) of less than 25 degrees Celsius (more preferably less than 6 degrees Celsius), thus causing an ink composition of liquid inks 52, 60, 68 and 76 containing the resin as a major component to undergo rapid film formation (rapid self fixing) in printing or imaging processes carried out at temperatures greater than the core Tg (preferably at or above 25 degrees Celsius). The use of low Tg resins to promote rapid self fixing of printed or toned images is known in the art, as exemplified by *Film Formation* (Z. W. Wicks, Federation of Societies for Coatings Technologies, p. 8 (1986). Rapid self fixing is thought to avoid printing defects (such as smearing or trailing-edge tailing) and incomplete transfer in high speed printing. For printing on plain paper, it is preferred that the core Tg be greater than minus 10 degrees Celsius and, more preferably, be in the range from minus 5 degrees Celsius to plus 5 degrees Celsius so that the final image is not tacky and has good block resistance.

Such rapid self fixing is required of liquid inks 52, 60 and 68 to enable such liquid inks 52, 60 and 68 to film form before being subjected to overlay by a subsequent liquid ink 60, 68 and 76 in the formation of a subsequent color plane of the image. It is preferred that liquid inks 52, 60, 68 and 76 self fix within 0.5 seconds to enable the apparatus to operate at sufficient speed and to ensure image quality. It is generally believed that such rapid self fixing will occur in liquid inks 52, 60, 68 and 76 which have greater than 75 percent volume fraction of solids in the image.

It is also preferred that the glass transition temperature (Tg) of liquid inks 52, 60, 68 and 76 be greater than minus ten degrees Celsius and less than plus 25 degrees Celsius so that the final image is not tacky and has good block resistance. More preferred is a Tg between minus 5 degrees Celsius and plus 5 degrees Celsius.

It is also preferred that liquid inks 52, 60, 68 and 76 have a low charge to mass ratio which assists in giving the resultant image high density. It is preferred that liquid inks 52, 60, 68 and 76 have a charge to mass ratio of from 0.025 to 0.1 microcoulombs/(centimeters$^2$ - OD). Liquid inks 52, 60, 68 and 76 have a charge to mass ratio of from 0.05 to 0.075 microcoulombs/(centimeters$^2$ - OD) in the most preferred embodiment. (This is the charge per developed optical density which is directly proportional to charge per mass.)

It is also preferred that liquid inks 52, 60, 68 and 76 have a low free phase conductivity which aids in providing high resolution, gives good sharpness and low background. It is preferred that liquid inks 52, 60, 68 and 76 have a free phase conductivity of less than 30 percent at 1 percent solids. It is still more preferred that liquid inks 52, 60, 68 and 76 have a free phase conductivity of less than 20 percent at 1 percent solids. A free phase conductivity of less than 10 percent at 1 percent solids is most preferred for liquid inks 52, 60, 68 and 76.

Examples of resin materials suitable for use in liquid inks 52, 60, 68 and 76 include polymers and copolymers of (meth)acrylic esters; including methyl acrylate, ethyl acrylate, butyl acrylate, ethylhexyl acrylate, 2-ethylhexylmethacrylate, lauryl acrylate, octadecyl acrylate, methyl methacrylate, ethyl methacrylate, lauryl methacrylate, 2-hydroxy ethyl methacrylate, octadecyl methacrylate and other polyacrylates. Other polymers may be used in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetate-butyrate copolymers, and poly(vinyl butyral) copolymers.

The colorants which may be used in liquid inks 52, 60, 68 and 76 include virtually any dyes, stains or pigments which may be incorporated into the polymer resin, which are compatible with the carrier liquid, and which are useful and effective in making visible the latent electrostatic image. Examples of suitable colorants include: Phthalocyanine blue (C.I. Pigment Blue 15 and 16), Quinacridone magenta (C.I. Pigment Red 122, 192, 202 and 206), Rhodamine YS (C.I. Pigment Red 81), diarylide (benzidine) yellow (C.I. Pigment Yellow 12, 13, 14, 17, 55, 83 and 155) and arylamide (Hansa) yellow (C.I. Pigment Yellow 1, 3, 10, 73, 74, 97, 105 and 111); organic dyes, and black materials such as finely divided carbon and the like.

The optimal weight ratio of resin to colorant in the toner particles is on the order of 1/1 to 20/1, most preferably between 10/1 and 3/1. The total dispersed "solid" material in the carrier liquid typically represents 0.5 to 20 weight percent, most preferably between 0.5 and 3 weight percent of the total liquid developer composition.

Liquid inks 52, 60, 68 and 76 include a soluble charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps. See U.S. Pat. No. 3,411,936, Rotsman et al. The preferred charge directors are polyvalent metal soaps of zirconium and aluminum, preferably zirconium octoate.

The particular liquid inks 52, 60, 68 and 76 preferred are described with more particularity in copending U.S. Pat. Application filed on even date herewith in the names of Baker et al, entitled "Printing Ink Containing Gelled Organosol", identified by File No. 52069USA8A, which is hereby incorporated by reference.

Photoreceptor 10 may be a photoconductive layer applied to an electroconductive substrate, an interlayer applied to the photoconductive layer, and a release layer over the interlayer. A preferred photoconductive layer is similar to that described in Example 6 of copending U.S. patent application Ser. No. 08/43 1,022, with thicknesses of the charge transfer layer of about 8.75 micrometers and the charge generation layer of about 0.3 micrometers. A preferred interlayer is:

| | |
|---|---|
| 325.4 grams | 6% S-lec BX-5, Sekisusi Chemical Co., in MeOH |
| 1395 grams | IPA |
| 50 grams | Nalco 1057 colloidal silica, Nalco Chemical Company |
| 49.5 grams | 5% Z-6040 silane, Dow Corning, in 50/50 IPA/$H_2O$ |
| 194.6 grams | 1.5% Gantrez ® AN-169 Polymer, ISP Technologies Inc., in 50/50 MeOH/$H_2O$. |

Stock solutions of the various raw materials can be made using % by weight. The materials can be added to a jar in the order in which they appear above and mixed thoroughly after each addition. The solution was extrusion coated over a photoreceptor construction consisting of aluminzed polyester, an inverted dual layer photoconductor (charge transport layer, charge generation layer) and air dried at 150 degrees Celsius for 1 minute to give a thickness of about 0.2 micrometers. The release layer may be a swellable polymer. By swellable is meant that the polymer is capable of absorbing carrier liquid in amounts greater than 60% of the weight of the polymer. If desired, the release layer may have rough surface, preferably with an $R_a$ from about 0 nanometers to about 100 nanometers.

The release layer may be a swellable polymer formed by cross linking a high molecular weight hydroxy terminated siloxane. More preferably, the release layer is the reaction product of a high molecular weight hydroxy terminated siloxane, a low molecular weight hydroxy terminated siloxane, and a cross-linking agent. If such a combination is used, the weight ratio of high molecular weight hydroxy terminated siloxane to low molecular weight hydroxy terminated siloxane is preferably in the range from 0.5:1 to 100:1, more preferably in the range from 1:1 to 20:1.

A preferred embodiment for photoreceptor 10 is similar to that described in Example 6 of copending U.S. patent application Ser. No. 08/431,022, which is hereby incorporated by reference. More preferred are the release layer described in this patent application in which the roughness has been increased by incorporating fillers so that $R_a$ is about 15 nanometers.

Charging device 18 is preferably a scorotron type corona charging device. Charging device 18 has high voltage wires (not shown) coupled to a suitable positive high voltage source of plus 4,000 to plus 8,000 volts. The grid wires of charging device 18 are disposed from about 1 to about 3 millimeters from the surface of photoreceptor 10 and are coupled to an adjustable positive voltage supply (not shown) to obtain an apparent surface voltage on photoreceptor 10 in the range plus 600 volts to plus 1000 volts or more depending upon the capacitance of photoreceptor. While this is the preferred voltage range, other voltages may be used. For example, thicker photoreceptors typically require higher voltages. The voltage required depends principally on the capacitance of photoreceptor 10 and the charge to mass ratio of the liquid ink utilized as the toner for apparatus 42. Of course, connection to a positive voltage is required for a positive charging photoreceptor 10. Alternatively, a negatively charging photoreceptor 10 using negative voltages would also be operable. The principles are the same for a negative charging photoreceptor 10.

Laser scanning device 50 imparts image information associated with a first color plane of the image, laser scanning device 58 imparts image information associated with a second color plane of the image, laser scanning device 66 imparts image information associated with a third color plane of the image and laser scanning device 74 imparts image information associated with a fourth color plane of the image. Although each of laser scanning devices 50, 58, 66 and 74 are associated with a separate color of the image and operate in the sequence as described above with reference to FIG. 3, for convenience they are described together below.

Laser scanning devices 50, 58, 66 and 74 include a suitable some of high intensity electromagnetic radiation. The radiation may be a single beam or an array of beams. The individual beams in such an array may be individually modulated. The radiation impinges, for example, on photoreceptor 10 as a line scan generally perpendicular to the direction of movement of photoreceptor 10 and at a fixed position relative to charging device 18.

The radiation scans and exposes photoreceptor 10 preferably while maintaining exact synchronism with the movement of photoreceptor 10. The image-wise exposure causes the surface charge of photoreceptor 10 to be reduced significantly wherever the radiation impinges. Areas of the surface of photoreceptor 10 where the radiation does not impinge are not appreciably discharged. Therefore, when photoreceptor 10 exits from under the radiation, its surface charge distribution is proportional to the desired image information.

The wavelength of the radiation to be transmitted by laser scanning devices 50, 58 and 66 is selected to have low absorption through the first three color planes of the image. The fourth image plane is typically black. Black is highly absorptive to radiation of all wavelengths which would be useful in the discharge of photoreceptor 10. Additionally, the wavelength of the radiation of laser scanning devices 50, 58, 66 and 74 selected should preferably correspond to the maximum sensitivity wavelength of photoreceptor 10. Preferred sources for laser scanning devices 50, 58, 66 and 74 are infrared diode lasers and light emitting diodes with emission wavelengths over 700 nanometers. Specially selected wavelengths in the visible may also be usable with some combinations of colorants. The preferred wavelength is 780 nanometers.

The radiation (a single beam or array of beams) from laser scanning devices 50, 58, 66 and 74 is modulated conventionally in response to image signals for any single color plane information from a suitable source such as a computer memory, communication channel, or the like. The mechanism through which the radiation from laser scanning devices is manipulated to reach photoreceptor 10 is also conventional.

The radiation strikes a suitable scanning element such as a rotating polygonal mirror (not shown) and then passes through a suitable scan lens (not shown) to focus the radiation at a specific raster line position with respect to photoreceptor 10. It will of course be appreciated that other scanning means such as an oscillating mirror, modulated fiber optic array, waveguide array, or suitable image delivery system may be used in place of or in addition to a polygonal mirror. For digital halftone imaging, it is preferred that radiation should be able to be focused to diameters of less than 42 microns at the one-half maximum intensity level assuming a resolution of 600 dots per inch. A lower resolution may be acceptable for some applications. It is preferred that the scan lens must be able to maintain this beam diameter across at least a 12 inches (30.5 centimeters) width.

The polygonal mirror typically is rotated conventionally at constant speed by controlling electronics which may include a hysteresis motor and oscillator system or a servo feedback system to monitor and control the scan rate. Photoreceptor 10 is moved orthogonal to the scan direction at constant velocity by a motor and position/velocity sensing devices past a raster line where radiation impinges upon photoreceptor 10. The ratio between the scan rate produced by the polygonal mirror and photoreceptor 10 movement speed is maintained constant and selected to obtain the required addressability of laser modulated information and overlap of raster lines for the correct aspect ratio of the final image. For high quality imaging, it is preferred that the polygonal mirror rotation and photoreceptor 10 speed are set so that at least 600 scans per inch, and still more preferably 1200 scans per inch, are imaged on photoreceptor 10. It is preferable not to have photoreceptor 10 travel substantially faster than about 3 inches/second (7.6 centimeters/second).

Developer station 52 develops the first color plane of the image, developer station 60 develops the second color plane of the image, developer station 68 develops the third color plane of the image and developer station 76 develops the fourth color plane of the image. Although each of developer stations 52, 60, 68 and 76 are associated with a separate color of the image and operate in the sequence as described above with reference to FIG. 3, for convenience they are described together below.

Conventional liquid ink immersion development techniques are used in developer stations 52, 60, 68 and 76. Two modes of development are known in the art, namely deposition of liquid ink 54, 62, 70 and 78 in exposed areas of photoreceptor 10 and, alternatively, deposition of liquid ink 54, 62, 70 and 78 in unexposed regions. The former mode of imaging can improve formation of halftone dots while maintaining uniform density and low background densities. Although the invention has been described using a discharge development system whereby the positively charged liquid ink 54, 62, 70 and 78 is deposited on the surface of photoreceptor 10 in areas discharged by the radiation, it is to be recognized and understood that an imaging system in which the opposite is true is also contemplated by this invention. Development is accomplished by using a uniform electric field produced by development electrodes 56, 64, 72 and 80 spaced near the surface of photoreceptor 10.

Developer stations 52, 60, 68 and 76 consist of a developer roll, squeegee roller 82, 84, 86 and 88, fluid delivery system, and a fluid return system. A thin, uniform layer of liquid ink 54, 62, 70 and 78 is established on a rotating, cylindrical developer roll (electrode) 56, 64, 72 and 80. A bias voltage is applied to the developer roll (electrode) intermediate to the unexposed surface potential of photoreceptor 10 and the exposed surface potential level of photoreceptor 10. The voltage is adjusted to obtain the required maximum density level and tone reproduction scale for halftone dots without any background being deposited. Developer roll (electrode) 56, 64, 72 and 80 is brought into proximity with the surface of photoreceptor 10 immediately before the latent image formed on the surface of photoreceptor 10 passes beneath the developer roll (electrode) 56, 64, 72 and 80. The bias voltage on developer roll (electrode) 56, 64, 72 and 80 forces the charged pigment particles, which are mobile in the electric field, to develop the latent image. The charged "solid" particles in liquid ink 54, 62, 70 and 78 will migrate to and plate upon the surface of photoreceptor 10 in areas where the surface charge of photoreceptor 10 is less than the bias voltage of developer roll (electrode) 56, 64, 72 and 80. The charge neutrality of liquid ink 54, 62, 70 and 78 is maintained by oppositely-charged substantially transparent counter ions which balance the charge of the positively charged ink particles. Counter ions are deposited on the surface photoreceptor 10 in areas where the surface voltage of photoreceptor 10 is greater than the electrode bias voltage.

After plating is accomplished by developer roll (electrode) 56, 64, 72 and 80, squeegee rollers 82, 84, 86 and 88 then rolls over the developed image area on photoreceptor 10 removing the excess liquid ink 54, 62, 70 and 78 and successively leaving behind each developed color plane of the image. Alternatively, sufficient excess liquid ink remaining on the surface of photoreceptor 10 could be removed in order to effect film formation by vacuum techniques well known in the art. The ink deposited onto photoreceptor 10 should be rendered relatively firm (film formed) by the developer roll (electrode) 56, 64, 72 and 80, squeegee rollers 82, 84, 86 and 88 or an alternative drying technique in order to prevent it from being washed off in a subsequent developing process(es) by developer stations 60, 68 and 76. Preferably, the ink deposited on photoreceptor should be dried enough to have greater than seventy-five percent by volume fraction of solids in the image.

Preferred squeegee rollers 82, 84, 86 and 88 are described in copending U.S. Pat. Application filed on even date herewith in the names of Moe et al, entitled Squeegee Apparatus and Method for Removing Developer Liquid from an Imaging Substrate and Fabrication Method, identified by File No. 52066USA4A, which is hereby incorporated by reference. Developer rolls (electrodes) 56, 64, 72 and 80 are kept clean by a developer cleaning roller as described in copending U.S. Pat. Application filed on even date herewith, entitled Apparatus and Method for Cleaning Developer from an Imaging Substrate, identified by File No. 51517USA8A, which is hereby incorporated by reference. Any further excess ink is removed by an additional roller described in copending U.S. Pat. Application filed on even date herewith, entitled Apparatus and Method for Removing Excess Ink from an Imaging Substrate, identified by File No. 52065USA6A, which is hereby incorporated by reference. The overall developer apparatus is described in detail in copending U.S. Pat. Application filed on even date herewith in the names of Teschendorf et al, entitled Development Apparatus for an Electrographic System, identified by File No. 52064USA8A, which is hereby incorporated by reference.

Developer stations 52, 60, 68 and 76 are similar to that described in U.S. Pat. No. 5,300,990, Thompson et al, which is hereby incorporated by reference. The preferred developer stations 52, 60, 68 and 76 differ from those described in the Thompson et al patent in that the preferred spacing between the developer roll surface and the surface of photoreceptor 10 is 150 microns (0.15 millimeters) instead of 50–75 microns (0.05–0.075 millimeters). Further, no wiper roller is used and squeegee rollers 82, 84, 86 and 88 are made of urethane. Once the development process for each color plane of the image is complete, the appropriate developer roll (electrode) 56, 64, 72 and 80 is retracted from the surface of photoreceptor 10, breaking the contact between liquid inks 54, 62, 70 and 78 and the surface of photoreceptor 10. The developer rolls (electrode) 56, 64, 72 and 80 dripline fluid is removed and captured by squeegee rollers 82, 84, 86 and 88.

The dripline of liquid inks 54, 62, 70 and 78 supplied by developer rolls (electrode) 56, 64, 72 and 80 on photoreceptor 10 advances toward squeegee rollers 82, 84, 86 and 88 as photoreceptor 10 moves on belt 44 and combines with liquid inks 54, 62, 70 or 78, respectively, already contained at the leading edge of squeegee rollers 82, 84, 86 and 88 (squeegee holdup volume). The excess liquid inks 54, 62, 70 and 78 from the dripline and the squeegee holdup volume will overflow down the front surface of squeegee rollers 82, 84, 86 and 88, a portion of it flowing into the fluid return system. After the imaged area of photoreceptor 10 is past squeegee rollers 82, 84, 86 and 88, a doctor blade (not shown) is brought into contact with the bottom of each squeegee roller 82, 84, 86 and 88. At the same time, squeegee rollers 82, 84, 86 and 88 begin rotating in the direction opposite the moving surface of photoreceptor 10 with a velocity of approximately 10 inches per second (25.4 centimeters per second). The fluid of liquid inks 54, 62, 70 and 78 in the nip of squeegee rollers 82, 84, 86 and 88 is taken away from the surface of photoreceptor 10 by the motion of squeegee rollers 82, 84, 86 and 88 and skived off squeegee rollers 82, 84, 86 and 88 by the doctor blade, from which it drains into the fluid return system. The rate at which the liquid ink 54, 62, 70 or 78 can be removed is a function of the velocity ratio of the surface of photoreceptor 10 to the surface of squeegee rollers 82, 84, 86 and 88. It is preferred that the doctor blade maintain intimate contact with the entire lateral width of the squeegee rollers 82, 84, 86 and 88 so that the doctor blade cannot swell or warp. The preferred material for the doctor blade is 3M brand Fluoroelastomer FC 2174, which is inert to liquid ink, manufactured by Minnesota Mining and Manufacturing Company, St. Paul, Minn.

It is preferred that squeegee rollers 82, 84, 86 and 88 have a crowned core as described in copending U.S. Pat. Application filed on even date herewith, entitled Squeegee Apparatus and Method for Removing Developer Liquid From an Imaging Substrate and Fabrication Method, identified by File No. 52066USA6A which is hereby incorporated by reference. Squeegee rollers 82, 84, 86 and 88 constructed in this manner provide better uniformity of pressure over the entire width of squeegee rollers 82, 84, 86 and 88. Such uniformity of pressure aids in eliminating excess carrier liquid, such as Norpar, from the formed image color plane.

Following development of the final color plane of the image on the surface of photoreceptor 10, the assembled image is further dried in drying mechanism 34. Drying the assembled image prevents image quality from degrading during subsequent image transfer operations and minimizes "carry out" of carrier liquid from liquid inks 52, 60, 68 and 76 from the apparatus. The ink should be dry enough just before transfer to stick to the transfer material and be lifted off the photoreceptor by such material. Dry preferably means ninety percent by volume fraction of solids in the image, more preferably ninety-five percent by volume fraction of solids in the image. Such drying is also thought to "condition" the assembled image for subsequent transfer so that the assembled image will pull off from photoreceptor 10 onto intermediate transfer roller 38.

The "solid" color pigments of liquid inks 52, 60, 68 and 76 form a film with sufficient cohesive strength on the surface of photoreceptor 10 before or during transfer to transfer roller 38. The image consisting of a cohesive film comprised of four layers of such "solid" color pigments of liquid inks 52, 60, 68 and 76 can be formed into a substantially dry film by using, for example, a drying roller 90. Preferably, drying roller 90 is a silicone coated roller that absorbs any remaining liquid. Drying roller 90 further dries, or "conditions" for subsequent transfer, by a drying station described in copending U.S. Pat. Application filed on even date herewith, in the names of Schilli et al, entitled Drying Method and Apparatus for Electrophotography Using Liquid Toners, identified by File No. 52063USA1A, which is hereby incorporated by reference. Although not preferred, drying mechanism 34 may be constructed of a conventional hot air blower or other conventional means.

The assembled image is then transferred in a single step to an transfer roller 38 for subsequent transfer to receptor medium 36. The assembled image on the surface of photoreceptor 10 is brought into pressure contact with transfer roller 38 constructed of an elastomer, preferably fluorosilicone, heated to temperature T1. Temperature T1 can be in the range of 25–130 degrees Celsius and, preferably from 50–100 degrees Celsius, most preferably about 90 degrees Celsius. At temperature T1, a tack develops between the elastomer of transfer roller 38 and liquid inks 54, 62, 70 and 78. Although a roller is preferred for transfer roller 38, a belt is also envisioned. The preferred pressure for contact between transfer roller 38 and photoreceptor 10 is 120 pounds (54.5 kilograms) or, alternatively, 95.25 pounds per square inch (32.5 kilograms per square centimeter) since the nip area is 1.25 square inches (8 square centimeters). The assembled liquid ink image adheres to the elastomer of transfer roller 38 when photoreceptor 10 and the elastomer surface of transfer roller 38 are separated. The surface of photoreceptor 10 releases the liquid ink image.

It is believed that the pressure contact between transfer roller 38 and photoreceptor enhances the dwell time during which the assembled image is in contact with both transfer roller 38 and the surface of photoreceptor 10. It is preferred that the materials and diameters of transfer roller 38 and photoreceptor 10 and the pressure between them be selected such that the dwell time is at least 25 milliseconds and, preferably, approximately 52 milliseconds.

The elastomer of transfer roller 38 has sufficient adhesive properties at temperature T1 to pick up the semi-dry liquid ink image from the surface of photoreceptor surface. Further, the elastomer of transfer roller 38 has sufficient release properties at temperature T2 to allow film form liquid ink image to be released to receptor medium 36. The elastomer of transfer roller 38 is able to conform to the irregularities in the surface of receptor medium 36, e.g. the irregularities of rough paper. Conformability is accomplished by using an elastomer having a Shore A Durometer hardness of about 65 or less, preferably 50. Preferably, the elastomer should be resistant to swelling and attack by the carrier medium, e.g., hydrocarbon, for liquid inks 52, 60, 68 and 76. The elastomer of transfer roller 38 has an adhesive characteristic relative to liquid inks 52, 60, 68 and 76 that is greater than the adhesive characteristic of liquid inks 52, 60, 68 and 76 and release surface of photoreceptor 10 at temperature T1, but less than the adhesive characteristic of liquid inks 52, 60, 68 and 76 and final receptor medium 36 at temperature T2. The choice of the elastomer of transfer roller 38 is dependent on the release surface of photoreceptor 10, the composition of liquid inks 52, 60, 68 and 76, and receptor medium 36. For the process described here, several fluorosilicone elastomers meet these requirements, e.g., Dow Corning 94003 fluorosilicone dispersion coating, available from Dow Corning Corporation, Midland, Mich.

Subsequently, the assembled liquid ink image adhered to transfer roller 38 is brought in pressure contact with receptor medium 36, e.g. plain paper, at temperature T2 through a nip created with backup roller 40. Temperature T2 ranges from not nominally above room temperature to around 100 degrees Celsius. In one embodiment, the temperature T2 is not critical. Heating for this image transfer step is substantially provided by already heated transfer roller 38. No additional heat is believed necessary to facilitate transfer between transfer roller 38 and receptor medium 36. However, it is also believed desirable that backup roller 40 be heated to approximately 40 degrees Celsius to prevent backup roller 40 from sucking a significant amount of heat from transfer roller 38. For this same reason, receptor medium 36 may be preheated to around 35 degrees Celsius before transfer is attempted from transfer roller 38 to plain paper 36. If desired, however, T2 can be in the range of 70–150 degrees Celsius and, preferably is about 115 degrees Celsius. Under an applied pressure of preferably around one-half to two-thirds of the pressure between intermediate transfer roller 38 and photoreceptor 10, preferably around 95 pounds per square inch (35 kilograms per square centimeter), the assembled liquid ink image bearing elastomer of transfer roller 38, preferably a rigid metal roller, conforms to the topography of the receptor medium 36 so that every part of the assembled liquid ink image, including small dots, can come into contact with the surface of receptor medium 36 and transfer to receptor medium 36.

The dry adhesive transfer technique of the present invention preferably relies on a relative surface energy hierarchy among the surface release layer of photoreceptor 10, intermediate transfer roller 38, liquid inks 54, 62, 70 and 78 and receptor medium 36. The surface energy of photoreceptor 10 should be less than the surface energy of intermediate transfer roller 38. Further, the surface energy of intermediate transfer roller 38 should be less than the surface energies of liquid inks 54, 62, 70 and 78. Still further, the surface energy of liquid inks 54, 62, 70 and 78 should be less than the surface energy of receptor medium 36. This relative hierarchy helps ensure a reliable and sequential transfer of the assembled color plane image during the method and apparatus of the present invention.

It is also preferred that the surface energy of photoreceptor 10 be at least 0.5 dyne per centimeter less than the surface energy of intermediate transfer roller 38. Most preferred is that the surface energy of photoreceptor 10 be at least 1.0 dyne per centimeter less than the surface energy of intermediate transfer roller 38.

It is also preferred that the surface energy of intermediate transfer roller 38 be at least 2.0 dyne per centimeter less than the surface energy of liquid inks 54, 62, 70 and 78. Most preferred is that the surface energy of intermediate transfer roller 38 be at least 4.0 dyne per centimeter less than the surface of liquid inks 54, 62, 70 and 78.

All surface energies are measured in dyne per centimeter at approximately room temperature, preferably at around 20–23 degrees Celsius. Typically, the surface energy of photoreceptor 10 ranges from around 24 dyne per centimeter to around 26 dyne per centimeter. Typically, the surface energy of intermediate transfer roller 38 ranges from around 26 dyne per centimeter to around 28 dyne per centimeter. Typically, the surface energy of liquid inks 54, 62, 70 and 78 ranges from around 30 dyne per centimeter to around 40 dyne per centimeter. Typical surface energies for receptor medium 36 range from around 40 dyne per centimeter for plain paper to around 42 for transparency film.

In some circumstances, the carrier liquid of liquid inks 54, 62, 70 and 78 may bead on the surface of photoreceptor. Such beading is undesirable since the presence of such beads of carrier liquid during subsequent imaging of photoreceptor may cause optical difficulties resulting in drop outs in the resulting color plane of the image. Such beading may generally be prevented by increasing the swellability of the surface of photoreceptor 10 and/or by adding a certain degree of surface roughness to photoreceptor. Such surface roughness may be achieved by adding a filler into the material forming the release layer surface of photoreceptor 10.

Figure 4:
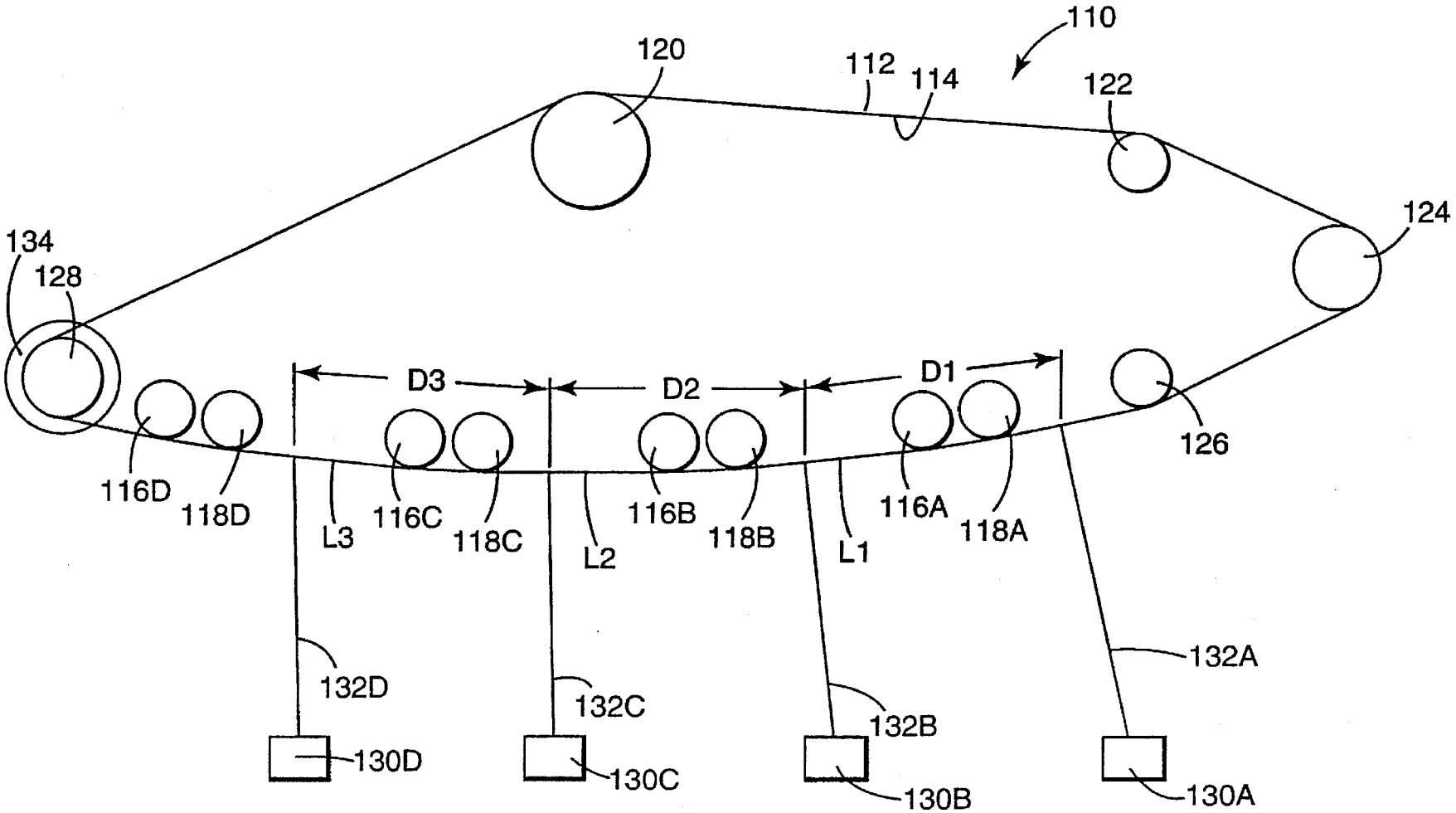
FIG. 4 is a more detailed illustration of the belt handling portion of the apparatus illustrated in FIG. 1.

FIG. 4 illustrates a photoreceptor in the form of a photoreceptive belt 110. The photoreceptive belt 110 has a belt outer surface 112 and a belt inner surface 114. FIG. 4 also illustrates one embodiment of a belt path created by thirteen rolls. The photoreceptive belt 110 can move along the belt path in a clockwise direction (and can reverse to counterclockwise direction during a cleaning step). The thirteen rolls include four squeegee back-up rolls 116A–D which provide support for four squeegee rolls (not shown, but positioned adjacent to the belt outer surface 112). Four developer back-up rolls 118A–D contact the belt inner surface 114 and are positioned opposite to four developer rolls (not shown, but positioned adjacent to the belt outer surface 112). A transfer back-up roll 120 provides support for a transfer roll (not shown, but positioned adjacent to the belt outer surface 112). A first belt-locating roll 122 is positioned between the transfer backup roll 120 and a belt-steering roll 124 to fix the location of the photoreceptive belt 110 relative to a charging device (not shown, but positioned adjacent to the belt outer surface 112). The belt-steering roll 124 can be biased such that the photoreceptive belt 110 is under tension. A second belt-locating roll 126 is positioned between the belt-steering roll 124 and the first developer back-up roll 118A to fix the location of the photoreceptive belt 110 relative to a first imaging device (not shown, but positioned adjacent to the belt outer surface 112). The second belt-locating roll 126 is a back-up roll providing support for a cleaning device (not shown, but positioned adjacent to the belt outer surface 112). A drive roll 128 is driven in a clockwise fashion and drives the photoreceptive belt 110 about the belt path. The drive roll 128 can also provide support for a drying roll (not shown, but positionable adjacent to the belt outer surface 112).

The four squeegee back-up rolls 116A–D, the four developer back-up rolls 118A–D, the transfer back-up roll 120, and the first and second belt-locating rolls 122, 126 are idler rolls and can include dead shafts (not shown) to provide non-rotating alignment reference for mating rolls such as the squeegee, developer, cleaning, and transfer rolls. These rolls could, instead, include live shafts with beating devices mounted on the journals (not shown).

The thirteen rolls are positioned such that photoreceptive belt 110 contacts at least three degrees of the circumference of each roll. However, the photoreceptive belt 110 is shown as contacting significantly more than three degrees of the of the circumferences of the transfer back-up roll 120, the first belt-locating roll 122, the belt-steering roll 124, the second belt-locating roll 126 and the drive roll 128.

The diameter of the squeegee back-up rolls 116A–D, the developer back-up rolls 118A–D, and the first and second belt-locating rolls 122, 126 can be, for example, approximately 0.75 inch (1.59 centimeters), or 1.0 inch (2.54 centimeters). The diameter of the transfer back-up roll 120 can be, for example, approximately 1.50 inches (3.81 centimeters). The diameter of the belt-steering roll 124 can be, for example, approximately 1.10 inches (2.79 centimeters). The diameter of the drive roll 128 can be, for example, approximately 1.053 inches (2.67 centimeters). The belt thickness can be, for example, 0.004 inch (0.01 centimeter).

The distance from the outside portion of the drive roll 128 (the portion contacting the photoreceptive belt 110) to the outside portion of the belt-steering roll 124 (the portion contacting the photoreceptive belt 110) can be approximately 16.9 inches (42.93 centimeters). FIG. 4, being proportionately illustrated, shows the approximate location of each roll relative to the other rolls. For example, the arched spacing between the first and second developer back-up rolls 118A, B is the same as the arched spacing between the second and third developer back-up rolls 118B,C and the arched spacing between the third and fourth developer back-up rolls 118C,D.

FIG. 4 also illustrates four laser scanning devices 130A–D. These devices 130A–D produce four corresponding laser beams 132A–D which strike the photoreceptive belt 110. The distances D1–3 between the locations where the laser beams 132A–D strike the photoreceptive belt 110 are important for accurately registering the image applied to the photoreceptive belt 110 by the first laser beam 132A with the images applied to the photoreceptive belt 110 by the second, third, and fourth laser beams 132B–D.

The laser scanning devices 130A–D are configured and the distances D1–3 are set such that the length L1 of the photoreceptive belt 110 between where the first and second laser beams 132A,B strike the photoreceptive belt is approximately 3.33 inches (8.46 centimeters), the length L2 of photoreceptive belt 110 between the locations where the second and third laser beams 132B,C strike the photoreceptive belt 110 is approximately 3.33 inches (8.46 centimeters), and the length L3 of the photoreceptive belt 110 between the locations where the third and fourth laser beams 132C,D strike the photoreceptive belt 110 is approximately 3.33 inches (8.46 centimeters). As a result, these lengths L1–3 are very close to being, if not exactly, equal to the product of Pi and the effective diameter of the drive roll 128 when wrapped with the photoreceptive belt 110 (the product of 3.14159×(1.053+0.004+0.004 inches)=3.333 inches).

The match between the lengths L1–3 and the circumference can be very important because the drive roll 128 (the drive roll) can itself be imperfect or it can be mounted imperfectly. This imperfection can cause the velocity of the photoreceptive belt 110 to vary within each revolution of the drive roll 128 (i.e., the velocity variation is cyclical with the revolution of the drive roll 128). An example of such an imperfection could be the imperfect roundness of the drive roll 128. Another example could be the concentricity of the drive roll 128 relative to the journal bearings (not shown) of the drive roll 128. The velocity variation results in image variation. However, the match of the lengths L1–3 and the circumference causes the variation within the image created by the first laser beam 132A to be registered, if you will, with the variation within the image created by the second, third, and fourth laser beams 132B–D. Although the variation within a single image created by a single laser beam may not be visible (i.e., not visibly significant), inaccurate registration of four images created by the four laser beams can be very visible (i.e., visibly significant).

The drive roll 128 can be directly coupled to and driven by a stepper motor 134. A standard stepper motor 134 has 200 poles that define the discrete rotational positions or steps. Stepper motor drivers bias the poles forcing the motor to take full or partial steps. If stepper motor 134 were microstepped to provide, for example, 2000 steps to revolve the drive roll 128 (3.33-inch circumference), the photoreceptive belt would be driven a distance of 1.0 inch (2.54 centimeters) for every 600 steps (assuming zero slippage). If the laser beams 132A–D are scanned with each step, the laser scanning resolution of this arrangement is 600 lines per inch.

Rather than making the circumference of the drive roll 128 equal to the lengths L1–3, accurate registration could be accomplished by making the lengths L1–3 equal to any integer multiple of the circumference of the drive roll 128.

Consequently, a number of arrangements can be made which coordinate the driving of the photoreceptive belt 110 with the lengths. And, larger or smaller circumferences and shorter or longer lengths could be used rather than the 3.33-inch (8.46-centimeter) dimension. This dimension can be chosen based on the size constraint or preference of the apparatus which includes the belt 110 and rollers; based on the availability of various roll sizes and various stepper motor 134 configurations; based on laser spacing constraints or preferences; and based on other constraints or preferences (such as directly coupling the stepper to the drive roll 128 or including the cost and componentry for gearing the two).

In addition, drive means other than stepper motor 134 and the drive roll 128 could be used and still provide the above-noted means for providing accurate registration. For example, the drive roll 128 could be replaced by a small driven belt (not shown). Many other modifications are envisioned as part of this invention.

While the present invention has been described with respect to it preferred embodiments, it is to be recognized and understood that changes, modifications and alterations in the form and in the details may be made without departing from the scope of the following claims.

What is claimed is:

1. An apparatus for producing an image on a receptor media from image data, comprising:

a photoreceptor having a surface release;

charge producing means for producing an image-wise distribution of charges on said photoreceptor corresponding to said image data;

liquid ink having solid charged pigmented particles, said liquid ink having an effective glass transition temperature of not less minus 10 degrees Celsius but at least one degree less than the temperature at which development takes place;

application means for applying said liquid ink to said photoreceptor forming an image-wise distribution of said pigmented particles on said photoreceptor to form said image;

film forming means positioned against said photoreceptor immediately following said application means for drying said image of said liquid ink to film forming within 0.5 seconds so that said liquid ink has greater than seventy-five percent by volume fraction of solids in said image;

drying means positioned proximate said photoreceptor following said film forming means for drying said image on said photoreceptor;

an elastomeric transfer roller forming a first transfer nip under pressure with said photoreceptor, said transfer roller receiving said image from said photoreceptor, said elastomeric transfer roller being heated to from 50 degrees Celsius to 100 degrees Celsius; and a backup roller forming a second transfer nip under pressure with said transfer roller, said receptor media passing through said second transfer nip and receiving said image from said transfer roller;

said release layer of said photoreceptor having a surface energy which is less than a surface energy of said elastomeric transfer roller;

said surface energy of said elastomeric transfer roller being less than a surface energy of said liquid ink;

said surface energy of said image formed by said liquid ink being less than a surface energy of said receptor media.

2. An apparatus for producing a multi-colored image on a receptor media from image data representing a plurality of color planes, comprising:

a photoreceptor having a surface release layer;

charge producing means for producing an image-wise distribution of charges on said photoreceptor corresponding to said image representing one of said plurality of color planes;

a first liquid ink having solid charged pigmented particles, said first liquid ink having an effective glass transition temperature of not less than minus 10 degrees Celsius but at least one degree less than the temperature at which development takes place, said pigmented particles being substantially representative said one of said plurality of color planes;

first application means for applying said first liquid ink to said photoreceptor forming an image-wise distribution of said pigmented particles on said photoreceptor to form one of said plurality of color planes;

first film forming means positioned against said photoreceptor immediately following said first application means for drying said image of said liquid ink to film forming within 0.5 seconds so that said first liquid ink has greater than seventy-five percent by volume fraction of solids in said image;

a second liquid ink having solid charged pigmented particles, said second liquid ink having an effective glass transition temperature of not less than minus 10 degrees Celsius but at least one degree less than the temperature at which development takes place, said pigmented particles being substantially representative another of said plurality of color planes;

second application means for applying said second liquid ink to said photoreceptor forming an image-wise distribution of said pigmented particles on said photoreceptor to form another of said plurality of color planes;

a second film forming means positioned against said photoreceptor immediately following said second application means for drying said image of said liquid ink to film forming within 0.5 seconds;

drying means positioned proximate said photoreceptor following said film forming means for drying said image on said photoreceptor so that said first liquid ink and said second liquid ink have greater than seventy-five percent by volume fraction of solids in said image;

an elastomeric transfer roller forming a first transfer nip under pressure with said photoreceptor, said transfer roller receiving said plurality of color planes from said photoreceptor, said elastomeric transfer roller being heated to from 50 degrees Celsius to 100 degrees Celsius; and a backup roller forming a second transfer nip under pressure with said transfer roller, said receptor media passing through said second transfer nip and receiving said plurality of color planes from said transfer roller;

said release layer of said photoreceptor having a surface energy which is less than a surface energy of said elastomeric transfer roller;

said surface energy of said elastomeric transfer roller being less than a surface energy of said first liquid ink and said second liquid ink;

said surface energy of said image formed by said first liquid ink and said second liquid ink being less than a surface energy of said receptor media.

3. A method of producing an image on a receptor media from image data, comprising the steps of:

producing an image-wise distribution of charges on a photoreceptor corresponding to said image data;

liquid ink having solid charged pigmented particles, said liquid ink having an effective glass transition temperature of not less than minus 10 degrees Celsius but at least one degree less than the temperature at which development takes place;

applying liquid ink having solid charged pigmented particles to said photoreceptor forming an image-wise distribution of said pigmented particles on said photoreceptor to form said image, said liquid ink having an effective glass transition temperature of not less than 10 degrees Celsius but at least one degree less than the temperature at which development takes place;

fixing said image immediately following said applying step with a film forming means positioned against said photoreceptor for drying said image of said liquid ink to film forming within 0.5 seconds so that said image has greater than seventy-five percent by volume fraction of solids;

drying said image on said photoreceptor following said film forming means;

transferring said image from said photoreceptor to an elastomeric transfer roller forming a first transfer nip under pressure with said photoreceptor, said elastomeric transfer roller being heated to from 50 degrees Celsius to 100 degrees Celsius; and transferring said image from said elastomeric transfer roller to a receptor media in a second transfer nip under pressure from said backup roller, said receptor media passing through said second transfer nip;

said release layer of said photoreceptor having a surface energy which is less than a surface energy of said elastomeric transfer roller;

said surface energy of said elastomeric transfer roller being less than a surface energy of said liquid ink;

said surface energy of said image formed by said liquid ink being less than a surface energy of said receptor media.

4. A method of producing a multi-colored image on a receptor media from image data representing a plurality of color planes, comprising the steps of:

producing an image-wise distribution of charges corresponding to said image representing one of said plurality of color planes on a photoreceptor having a surface release layer;

first applying a first liquid ink having solid charged pigmented particles to said photoreceptor forming an image-wise distribution of said pigmented particles on said photoreceptor to form one of said plurality of color planes, said first liquid ink having an effective glass transition temperature of not less than minus 10 degrees Celsius but at least one degree less than the temperature at which development takes place, said pigmented particles being substantially representative said one of said plurality of color planes;

fixing said one of said plurality of color planes immediately following said first applying step to dry said image of said liquid ink to film forming within 0.5 seconds with a first film forming means positioned against said photoreceptor so that said one of said plurality of color planes has greater than seventy-five percent by volume fraction of solids;

second applying a second liquid ink having solid charged pigmented particles to said photoreceptor forming an image-wise distribution of said pigmented particles on said photoreceptor to form another of said plurality of color planes, said second liquid ink having an effective glass transition temperature of not less than minus 10 degrees Celsius but at least one degree less than the temperature at which development takes place, said pigmented particles being substantially representative said another of said plurality of color planes;

fixing said another of said plurality of color planes immediately following said second applying step to dry said image of said liquid ink to film forming within 0.5 seconds with a second film forming means positioned against said photoreceptor so that said another of said plurality of color planes has greater than seventy-five percent by volume fraction of solids;

drying said image on said photoreceptor following said second film forming means;

transferring said image from said photoreceptor to an elastomeric transfer roller forming a first transfer nip under pressure with said photoreceptor, said elastomeric transfer roller being heated to from 50 degrees Celsius to 100 degrees Celsius; and transferring said image from said elastomeric transfer roller to said receptor media in a second transfer nip under pressure with a backup roller, said receptor media passing through said second transfer nip;

said release layer of said photoreceptor having a surface energy which is less than a surface energy of said elastomeric transfer roller;

said surface energy of said elastomeric transfer roller being less than a surface energy of said liquid ink;

said surface energy of said image formed by said liquid ink being less than a surface energy of said receptor media.

* * * * *